US010869518B1

(12) United States Patent
Leon

(10) Patent No.: US 10,869,518 B1
(45) Date of Patent: Dec. 22, 2020

(54) CHIN STRAP ASSEMBLY FOR A PROTECTIVE HELMET

(71) Applicant: Lionhead Helmet Intellectual Properties, LP, Ambler, PA (US)

(72) Inventor: Robert L. Leon, Ambler, PA (US)

(73) Assignee: LIONHEAD HELMET INTELLECTUAL PROPERTIES, LP, Ambler, PA (US)

( * ) Notice: Subject to any disclaimer, the term of this patent is extended or adjusted under 35 U.S.C. 154(b) by 0 days.

(21) Appl. No.: 16/866,670

(22) Filed: May 5, 2020

(51) Int. Cl.
*A42B 3/08* (2006.01)
*A44B 17/00* (2006.01)

(52) U.S. Cl.
CPC ..... *A42B 3/08* (2013.01); *A44B 17/0011* (2013.01)

(58) Field of Classification Search
CPC ..... A42B 3/08; A42B 3/085; A44B 17/0011; A44B 11/006; Y10T 24/3424
See application file for complete search history.

(56) References Cited

U.S. PATENT DOCUMENTS 1,447,440 A * 3/1923 Stenman ..... A44B 17/0011 24/665
1,651,340 A * 11/1927 Carr ..... A44B 17/0011 24/675
1,904,055 A * 4/1933 King ..... A44B 17/0005 24/324
2,061,466 A * 11/1936 Johnson ..... A44B 17/0017 24/324
2,253,816 A * 8/1941 Sherwood ..... A41F 9/002 24/163 R
2,486,652 A * 11/1949 Huelster ..... A44B 11/006 24/324
2,615,223 A * 10/1952 Bedford, Jr. ..... A44B 17/0005 24/198
3,237,257 A * 3/1966 Forsberg ..... A44B 11/006 24/324
4,051,556 A * 10/1977 Davenport ..... A42B 3/08 2/421
4,793,031 A * 12/1988 Kasai ..... A45C 13/30 24/324
4,847,959 A * 7/1989 Shimada ..... A44B 17/0011 24/671
4,903,349 A * 2/1990 Arai ..... A42B 3/08 2/421

(Continued)

*Primary Examiner* — Heather Mangine
(74) *Attorney, Agent, or Firm* — Panitch Schwarze Belisario & Nadel LLP

(57) ABSTRACT

A chin strap assembly having a pad portion and a strap portion for a protective helmet. The strap portion of the chin strap assembly includes a first strap having first and second major sides and a terminal end and a second strap having first and second major sides and a terminal end. A socket is secured proximate the terminal end of the first strap. The socket includes a cavity therein. A stud is secured proximate the terminal end of the second strap in engagement with the first major side thereof. The stud is releasably secured in the cavity. A longitudinal plate having a first end and a second end is positioned on the second major side of the second strap. The stud is secured to the plate proximate the second end thereof with the first end of the plate extending away from terminal end of the second strap. A distance between the first and second ends of the plate is between 0.5 and 2.5 inches.

5 Claims, 5 Drawing Sheets

(56) References Cited

U.S. PATENT DOCUMENTS 5,347,660 A * 9/1994 Zide ..... A42B 3/08 2/421
5,933,929 A * 8/1999 Kawakami ..... A44B 17/0035 24/324
6,481,024 B1 * 11/2002 Grant ..... A42B 3/08 2/421
6,532,632 B1 * 3/2003 Halstead ..... A44B 11/04 24/196
9,486,028 B1 * 11/2016 VanHoutin ..... A44B 17/0088
2004/0098793 A1 * 5/2004 Gershenson ..... A42B 3/08 2/425
2006/0242803 A1 * 11/2006 Drake ..... A44B 11/04 24/324
2007/0083986 A1 * 4/2007 Kaiser ..... A42B 3/08 2/410
2010/0192286 A1 * 8/2010 Bologna ..... A42B 3/08 2/421
2010/0319109 A1 * 12/2010 Field ..... A42B 3/08 2/421
2011/0072547 A1 * 3/2011 Doria ..... F41H 1/08 2/2.5
2012/0144628 A1 * 6/2012 Mitchell, Jr. ..... A44B 11/006 24/191
2012/0297526 A1 * 11/2012 Leon ..... A63B 71/10 2/413
2014/0259545 A1 * 9/2014 King ..... A41F 9/002 24/170
2014/0325797 A1 * 11/2014 Hasegawa ..... A44B 17/0011 24/108
2016/0066641 A1 * 3/2016 Lemoine ..... A44B 11/2596 24/324
2017/0150787 A1 * 6/2017 Custer ..... A44B 11/04
2018/0049505 A1 * 2/2018 Hovan ..... A42B 3/08
2018/0084858 A1 * 3/2018 Schiebl ..... A42B 3/08
2018/0279736 A1 * 10/2018 Paik ..... A44B 11/24
2019/0133263 A1 * 5/2019 Ichikawa ..... A44B 17/0011
2020/0093227 A1 * 3/2020 Martin ..... A44B 1/38

* cited by examiner

CHIN STRAP ASSEMBLY FOR A PROTECTIVE HELMET

BACKGROUND OF THE INVENTION

The present disclosure generally relates to the use of a snap connector to temporarily connect two straps. The snap connector contains a male or stud portion affixed to one strap, and a female or socket portion affixed to the other. Normally a snap connector is used to temporarily connect a strap to a rigid surface, for example as with a chin strap containing the female portion of the snap connector to the male portion of the snap connector located in the outer shell of a football helmet. Snap connectors are also used to temporarily connect one strap to another strap when high tensile forces are not involved, for instance in the use of an ice hockey helmet. However, for a strap-to-strap connection that may be put in significant tension, as would be typical for a chin strap and football helmet during its intended service, the line of centers through the connected male and female snap portions physically bends away from perpendicularity with the line of the tensile force thereby making the snap connection more likely to open than would have been the case had the line of centers remained more perpendicular to the line of the tensile force, as discussed in more detail below.

Referring to FIG. 1 there is shown the male part and the female part of a typical prior art snap connector, generally designated 10, in common usage today, along with how it would be connected to first and second separate straps 12, 20. The snap connector 10 includes a male snap or stud 14 secured to a terminal end 12*a* of the first strap 12. A T-nut 16 having an internally threaded extension 18 extends generally transversely therefrom through a complementarily sized hole 12*b* in the terminal end 12*a* of the first strap 12. A screw 22 is positioned in the stud 14 and threadably secured to the internally threaded extension 18 to thereby secure the stud 14 to the terminal end 12*a* of the first strap 12 in a manner well understood by those of ordinary skill in the art. The snap connector 10 further includes a female snap or socket 24 secured to a buckle 26. The buckle 26 has two slots 28 for receiving a terminal end 20*a* of the second strap 20 therethrough in a secured fashion in a manner well understood by those of ordinary skill in the art. The first and second straps 20 are typically made from either nylon or other polymer or reinforced polymer or leather. Each slot 28 has a row of teeth 29 on the tension side to prevent the second strap 20 from slipping after being properly adjusted for length.

Referring now to FIG. 2, when the snap connector 10 is connected and placed in tension as reflected by the arrows T, the centerline B through the snap connection 10 will bend away from the line of perpendicularity A as a result of bending of the first strap 12 adjacent the stud 14 at point P. The main problem with this bending is it creates an angle, θ, between the line of perpendicularity A and the centerline B of the snap connector 10. This angle of approximately 20° allows forces that act along the first and second straps 12, 20, such as the tension or its components, to disconnect the connection between the stud 14 and socket 24. These forces are some of the most common forces a strap endures making this a fundamental problem with this prior art. The present invention addresses that problem through the inclusion of an additional element which acts to prevent the centerline of the connected snap portions from bending away from the line of perpendicularity during the application of tensile forces T.

The need for a snap connector to temporarily connect two straps might come about with the use of a two-shell football helmet, where the chin strap is to be connected to the inner shell rather than the outer shell. See for example the two-shell helmet disclosed in U.S. Pat. No. 9,032,558, which is hereby incorporated by reference in its entirety. In that case, there may be no room for a player's hand to be able to reach up between the two shells to be able to make the temporary snap connection. To solve that problem a strap extension could be employed, the strap extension being a strap that would be more permanently attached to the inner shell at one end and extend to a place where the temporary snap connection could easily be made at the other end of the extension strap which would contain the male portion of the temporary snap connector.

BRIEF SUMMARY OF THE INVENTION

Briefly stated, the present disclosure is directed to a strap portion of a chin strap assembly for a protective helmet. The chin strap assembly includes a first strap having first and second major sides and a terminal end and a second strap having first and second major sides and a terminal end. A socket is secured proximate the terminal end of the first strap in engagement with the first major side thereof. The socket includes a cavity therein. A stud is secured proximate the terminal end of the second strap in engagement with the first major side thereof. The stud is releasably secured in the cavity. A longitudinal plate having a first end and a second end is secured to the second major side of the second strap. The stud is secured to the plate proximate the second end thereof with the first end of the plate extending away from terminal end of the second strap. A distance between the first and second ends of the plate is between 0.5 and 2.5 inches.

Briefly stated, another aspect the present disclosure is directed to a combination helmet and chin strap assembly. The combination includes a helmet and a first strap having first and second major sides, a terminal end and a proximal end. The proximal end of the first strap is secured to the chin pad portion of the chin strap assembly. A second strap has first and second major sides, a terminal end and a proximal end. The proximal end of the second strap is secured to the helmet. A socket is secured proximate a terminal end of the first strap. The socket includes a cavity therein. A stud is secured proximate a terminal end of the second strap in engagement with the first major side thereof. The stud is releasably secured in the cavity. A longitudinal plate, having a first end and a second end, is secured to the second major side of the second strap. The stud is secured to the plate proximate the second end thereof with the first end of the plate extending away from terminal end of the second strap. A distance between the first and second ends of the plate is between 0.5 and 2.5 inches.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
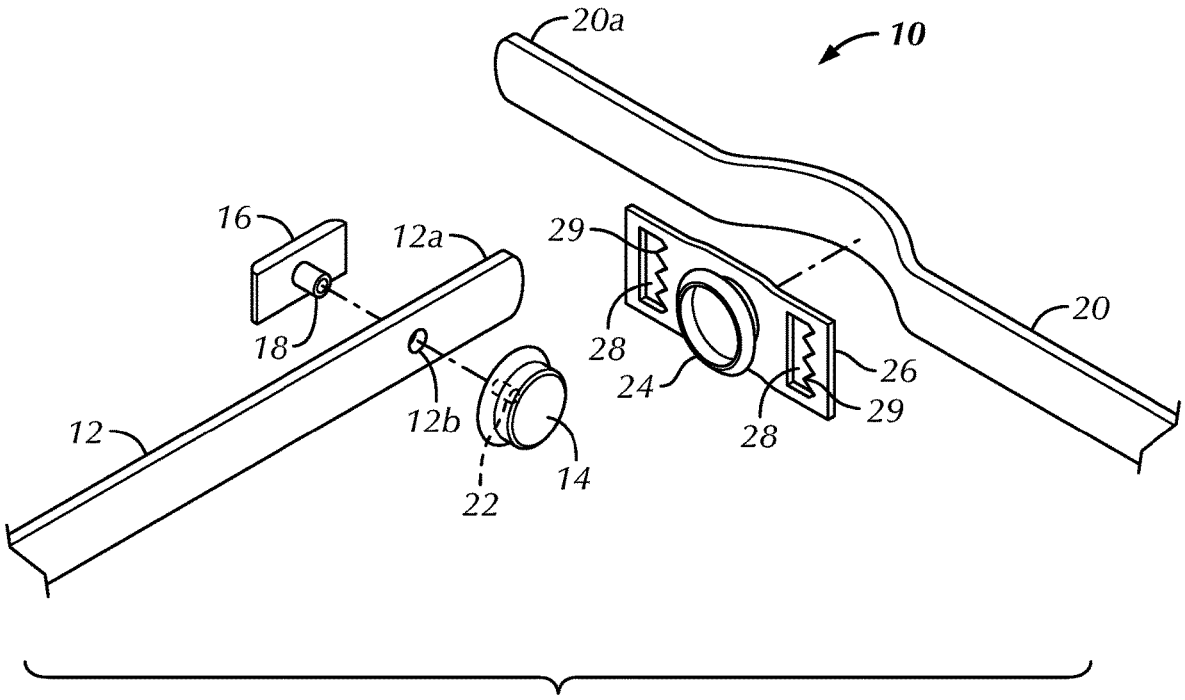
FIG. 1 (Prior Art)
FIG. 1 is a perspective exploded view of a strap portion of a prior art chin strap assembly.
Figure 2:
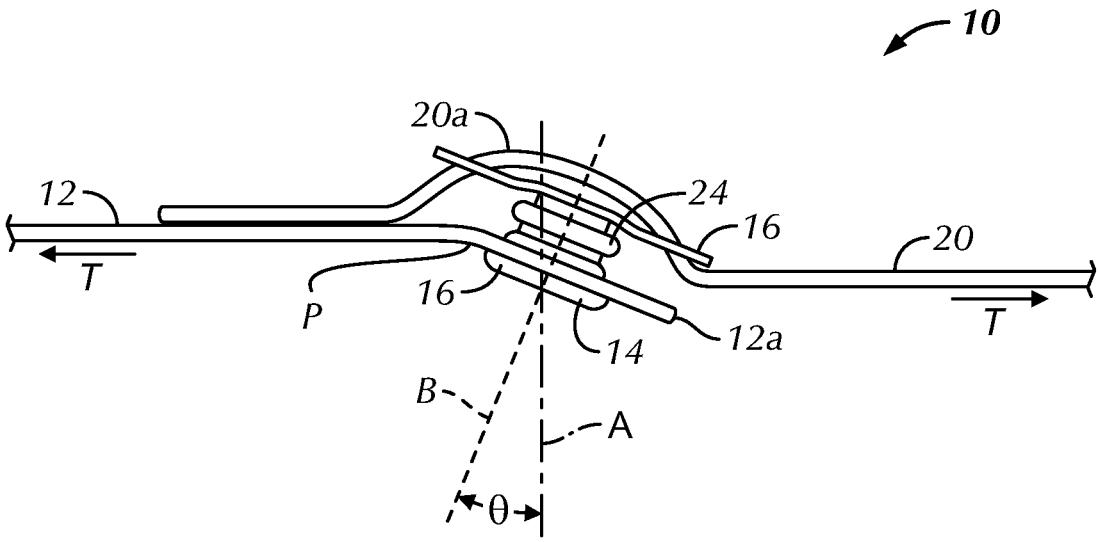
FIG. 2 (Prior Art)
FIG. 2 is a side view of the configuration of FIG. 1 when the strap portion of the chin strap assembly is placed in tension.

Certain terminology is used in the following description for convenience only and is not limiting. The words "lower," "bottom," "upper" and "top" designate directions in the drawings to which reference is made. The words "inwardly," "outwardly," "upwardly" and "downwardly" refer to directions toward and away from, respectively, the geometric center of the strap portion of the chin strap assembly, and designated parts thereof, in accordance with the present disclosure. Unless specifically set forth herein, the terms "a," "an" and "the" are not limited to one element, but instead should be read as meaning "at least one." The terminology includes the words noted above, derivatives thereof and words of similar import.

It should also be understood that the terms "about," "approximately," "generally," "substantially" and like terms, used herein when referring to a dimension or characteristic of a component of the disclosure, indicate that the described dimension/characteristic is not a strict boundary or parameter and does not exclude minor variations therefrom that are functionally similar. At a minimum, such references that include a numerical parameter would include variations that, using mathematical and industrial principles accepted in the art (e.g., rounding, measurement or other systematic errors, manufacturing tolerances, etc.), would not vary the least significant digit.

Figure 3:
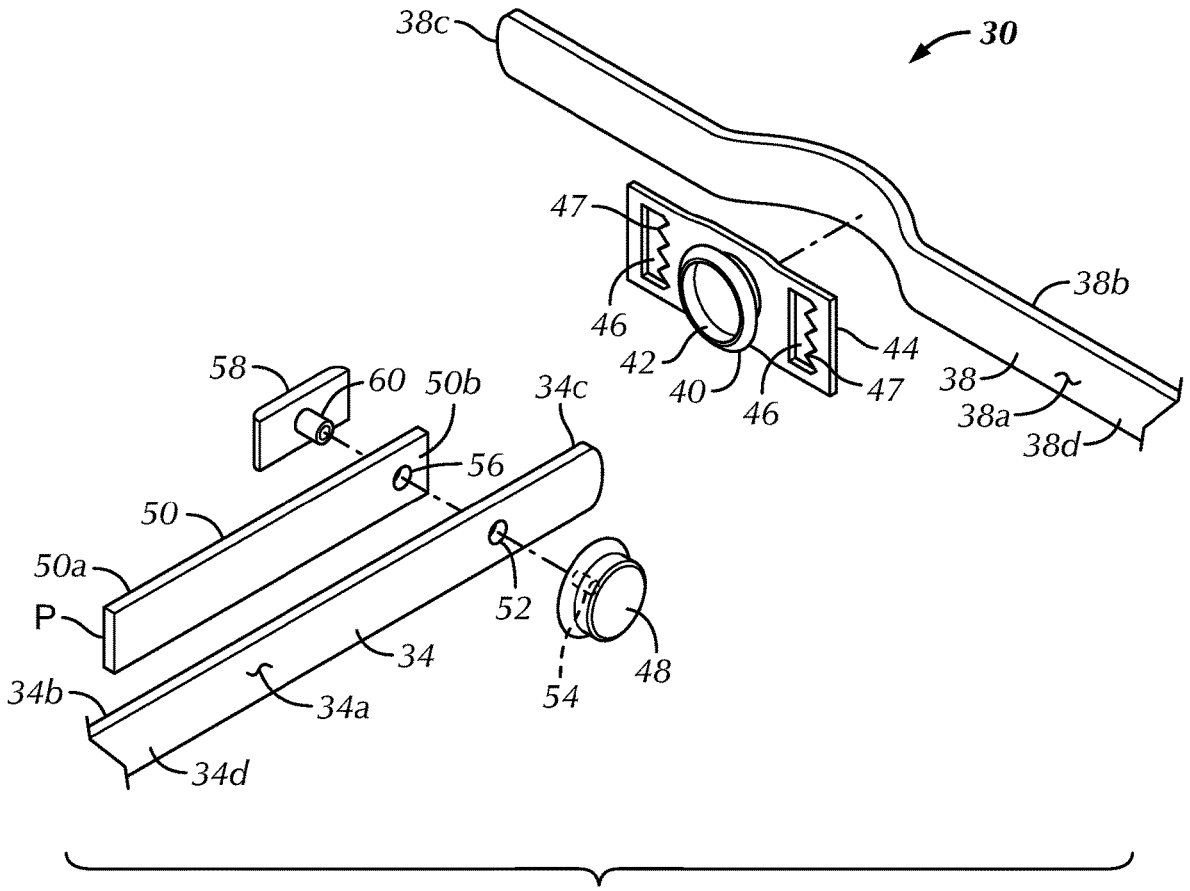
FIG. 3 is a perspective exploded view of a strap portion of a chin strap assembly in accordance with the present disclosure.
Figure 4:
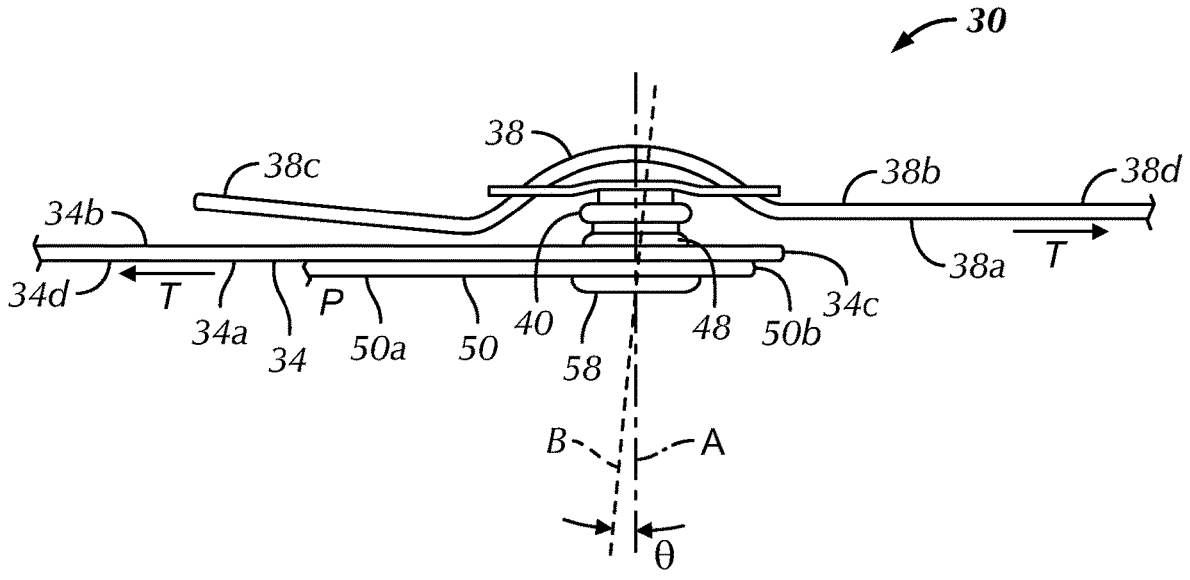
FIG. 4 is a side view of FIG. 3 when the strap portion of the chin strap assembly is assembled and placed in tension.
Figure 5:
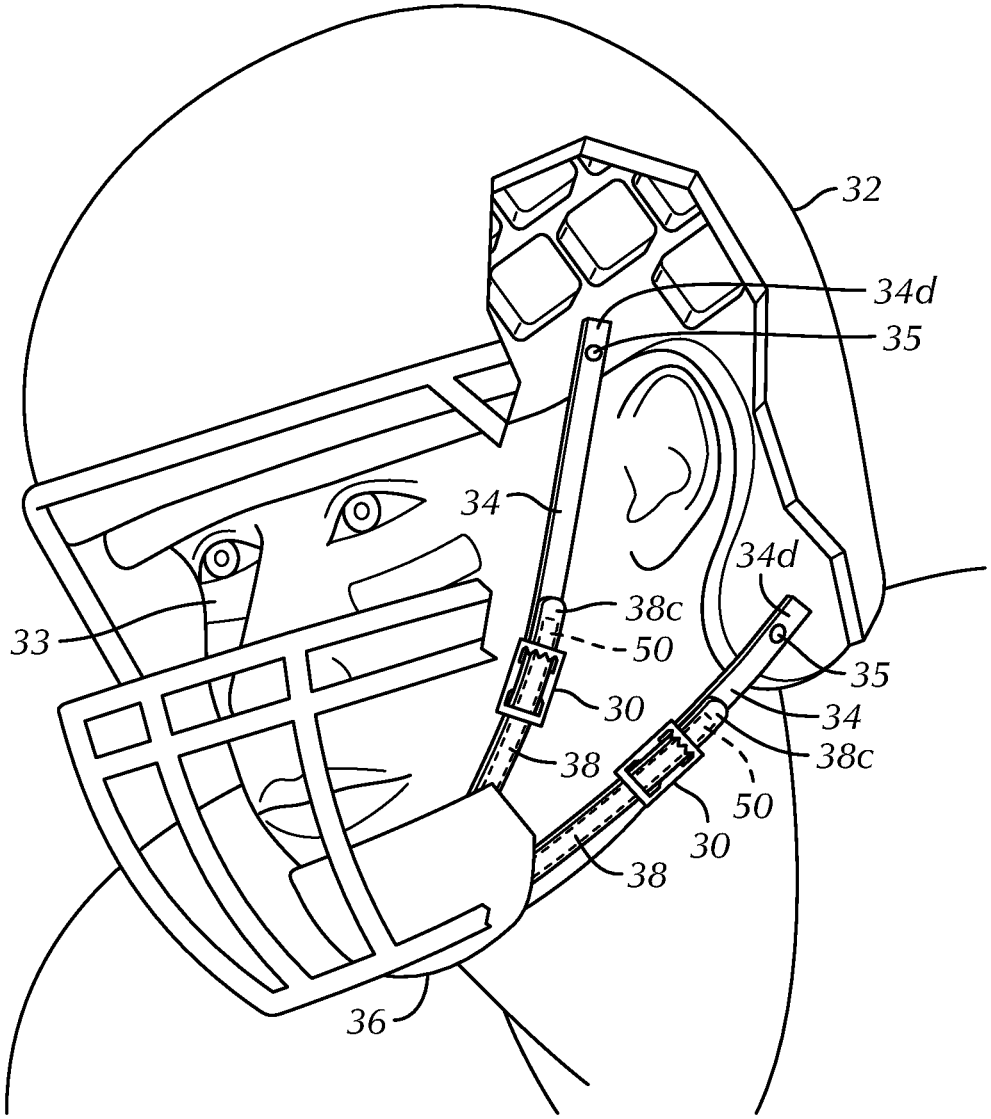
FIG. 5 is a partially broken away front left side perspective view of a helmet worn by a user employing the chin strap assembly of FIG. 3, wherein one strap portion of each of two pairs of strap portions is shown.

Referring now to FIGS. 3-5, there is shown a strap portion of a chin strap assembly, generally designated 30, designed to be affixed onto a protective helmet 32. The helmet 32 can be of any variety and for any purpose, including a single or double shell helmet. A double shell helmet 32 positioned on a human head 33 is shown in FIG. 5 and is more fully described in U.S. Pat. No. 9,032,558. Referring now to FIGS. 3 and 4, the strap portion of a chin strap assembly 30 includes first and second straps 38, 34 respectively. The second strap 34 having first and second major sides 34*a*, 34*b*, respectively, and a terminal end and a proximal end 34*c*, 34*d*, respectively. The proximal end 34*d* of the second strap 34 is releasably or permanently secured to the helmet 32 via a fastener 35, such as a rivet, as shown in FIG. 5, in a manner well understood by those of ordinary skill in the art. Accordingly, the detailed description thereof is omitted for purposes of convenience only and is not limiting. The second strap 34 is preferably made from a high strength flexible material, such as nylon or leather.

A first strap 38 includes first and second major sides 38*a*, 38*b*, respectively, and a terminal end and proximal end 38*c*, 38*d*, respectively. The proximal end 38*d* of the first strap 38 is releasably or permanently secured to the chin pad 36, as shown in FIG. 5, in a manner well understood by those of ordinary skill in the art. Accordingly, a detailed description thereof is omitted for purposes of convenience only and is not limiting. A female snap or socket 40 is secured proximate a terminal end 38*c* of the first strap 38 via a buckle 44. The buckle 44 has two slots 46 with serrated teeth 47 for receiving a terminal end 38*c* of the first strap 38 therethrough in a secured fashion in a manner well understood by those of ordinary skill in the art. The socket 40 is preferably strongly secured to the buckle 44 in a standard manner, such as with a rivet (not shown). The socket 40 includes a cavity 42 therein. The second strap 34 is typically made from a high strength flexible material, such as nylon or leather.

A male snap or stud 48 is secured proximate the terminal end 34*c* of the second strap 34 in engagement with the first major side 34*a*. The stud 48 is releasably frictionally secured with an interference fit in the cavity 42 in a manner well understood by those of ordinary skill in the art. A longitudinal plate 50 having a first end 50*a* and a second end 50*b* is secured in facing engagement to the second major side 34*b* of the second strap 34. The stud 48 is secured to the plate 50 proximate the second end 50*b* thereof with the first end 50*a* of the plate 50 extending away from terminal end 34*c* of the second strap 34. That is, the terminal end 34*c* of the second strap 34 has an aperture 52 extending therethrough and the stud 48 has a fastener or screw 54 extending therefrom through the aperture 52 and a mounting hole 56 in the second end 50*b* of the longitudinal plate 50. A T-nut 58 having an internally threaded extension 60 extends generally transversely therefrom through the aperture 52 and the mounting hole 56. The screw 54 is threadably secured to the internally threaded extension 60 to thereby secure the stud 54 to the terminal end 34*c* of the second strap 34 in a manner well understood by those of ordinary skill in the art. The remaining portion of the longitudinal plate 50 may be secured to the second major side 34*b* of the second strap 34 by an adhesive or other means, but it is not necessary since the plate 50 will properly perform its function without its remaining portion being thusly secured. The plate 50 is generally rigid and flat and preferably constructed of a high strength, comparatively lightweight material, such as a thin stainless steel, an aluminum or a composite fiber reinforced polymer. The width of the plate 50 is selected to generally correspond to at least half the width of the second strap 34 to enable an efficient transfer of forces between the second strap 34 and the longitudinal plate 50. Preferably the longitudinal plate 50 has a width which corresponds to the width of the second strap 34. A distance between the first and second ends 50*a*, 50*b* of the plate 50 is preferably between 0.5 and 2.5 inches, but may also be of a shorter length such as between 1.0 and 2.0 inches.

FIG. 4 shows the positive effect of including the longitudinal plate 50 when the first and second straps 38, 34 are snap connected and placed in tension represented by the arrows T. This time, with the same tensile force, the angle θ between the line of perpendicularity A and the centerline B is 3° as compared to 20° of the prior art. As a result, there is now little danger of the stud 48 and socket 40 separating. The desired reduced angular displacement comes about because the rigid longitudinal plate 50, which is now an extension of the stud 48, is kept from rotating by the tension in the second strap 34 at point P. The greater the strap tension, which wants to rotate the strap portion of the chin strap assembly 30, the greater the resisting torque at point P which acts to resist any rotation.

Although the present disclosure as illustrated and described herein appears quite simple and direct, the applications for its use are varied and numerous. In addition to the need for a strap extension from an inaccessible place where a snap connection cannot be physically made, for example: the cited case of a chin strap having to be snap connected to an inaccessible inner shell of a two shell helmet as shown in FIG. 5, there are many other applications of the present disclosure. One clear application would be an infinitely adjustable pre-adjustable snap connected belt for holding up one's pants. Here, the addition of a decorative cover for the female portion of the snap connector might be in order. Other applications could include infinitely adjustable, pre-adjustable, snap-connected harness straps, shoe straps, coat straps, or the like. In some applications the rigid plate 50 need not be flat but could be slightly curved to better accommodate the underlying object, and in some applications the male/female snap connector parts could take on a different form, and in still other applications the rigid plate, on its side opposite the strap, could be fitted with a thin layer of durable foam (not shown) for comfort purposes. All these applications and other similar applications would still be within the scope of the present disclosure.

It will also be appreciated by those skilled in the art that changes, or modifications, could be made to the above described embodiments without departing from the broad inventive concepts of the disclosure. For instance, the stud 48 could be attached to the buckle 44 attached to the first strap 38 and the socket 42 could be attached to the second strap 34 along with the plate 50. Thus, it is also possible the plate 50 could be associated with the socket 42 instead of the stud 48. It is also possible that the two-slotted buckle 44 could be replaced by a more modern version: a socket-holding ratchet housing through which the terminal end of the first strap 38 could pass and whereby the first strap 38 can be retained in an optimal position by a ratchet system (not shown). Therefore, it should be appreciated that the present disclosure is not limited to the particular use or embodiments disclosed but is intended to cover all uses and all embodiments within the scope or spirit of the described disclosure.

I claim:

1. A combination helmet and chin strap assembly, the combination comprising:

a helmet;

a chin strap assembly comprised of a chin pad portion and at least one pair of strap portions, each strap portion comprising:

a first strap having first and second major sides and a terminal end and proximal end, the proximal end of the first strap being secured to the chin pad portion;

a second strap having first and second major sides and a terminal end and proximal end, the proximal end of the second strap being secured to the helmet;

a socket secured proximate the terminal end of the first strap, the socket including a cavity therein;

a stud secured proximate the terminal end of the second strap in engagement with the first major side of the second strap, the stud being releasably secured in the cavity; and a longitudinal plate having a first end and a second end, the plate being positioned on the second major side of the second strap, the stud being secured to the plate proximate the second end thereof with the first end of the plate extending away from terminal end of the second strap, a distance between the first and second ends of the plate being between 0.5 and 2.5 inches, wherein the second strap has an aperture extending through the second strap at a location closer to the terminal end than to the proximal end of the second strap and the stud has a fastener extending through the aperture and fixedly secured to the plate at a point closer to the second end than to the first end of the plate.

2. The combination according to claim 1, wherein the distance between the first and second ends of the plate being between 1.0 and 2.0 inches.

3. The combination according to claim 1, wherein the plate is rigid.

4. The combination according to claim 1, wherein the second strap has a width and the plate has a width which is at least half the width of the second strap.

5. The combination according to claim 1, wherein the plate is secured in facing engagement with the second major side of the second strap.

* * * * *